United States Patent [19]

Johnson

[11] 4,003,546

[45] Jan. 18, 1977

[54] CONVERTIBLE WALER BRACE

[76] Inventor: Calvin R. Johnson, 2711 Winston Ave., Las Cruces, N. Mex. 88001

[22] Filed: Aug. 6, 1975

[21] Appl. No.: 602,304

[52] U.S. Cl. ..... 249/219 W; 249/46

[51] Int. Cl.[2] ..... E04G 17/04

[58] Field of Search ..... 249/40–47, 249/190–191, 213–214, 216–217, 219 W; 248/205 R

[56] References Cited

UNITED STATES PATENTS

| | | | |
|---|---|---|---|
| 2,307,274 | 1/1943 | Jenkins | 249/219 W |
| 2,637,889 | 5/1953 | Dulleck | 249/219 W |
| 2,967,689 | 1/1961 | Jahn | 249/219 W |
| 3,128,525 | 4/1964 | Kay | 249/219 W |
| 3,327,986 | 6/1967 | Oury | 249/219 W |
| 3,792,831 | 2/1974 | Verhey | 249/219 W |

*Primary Examiner*—Richard B. Lazarus
*Assistant Examiner*—John McQuade
*Attorney, Agent, or Firm*—Clarence A. O'Brien; Harvey B. Jacobson

[57] ABSTRACT

A waler brace or bracket is provided to be used for either a 3000-lb. forming system or a 5000-lb. forming system by accommodating either one 2×4 horizontal waler or a vertical stud in addition to a horizontal waler. The brace or bracket may be constructed so as to utilize a conventional sliding wedge lock or a conventional pivoted wedge lock and includes a base flange for abutting against the associated concrete form wall and a remote waler retaining flange adjustably shiftable for positioning at two different distances from the base flange. A first form of waler brace includes a slidably mounted waler retaining flange and a second form of the invention includes a pivoted waler retaining flange.

8 Claims, 6 Drawing Figures

CONVERTIBLE WALER BRACE

BACKGROUND OF THE INVENTION

Various forms of waler braces and brackets have been heretofore designed. Some forms of waler braces are constructed in a manner so as to be adjustable while other forms of braces are not adjustable. Further, the adjustable braces are constructed in a manner whereby adjustment thereof is either difficult or time consuming and the adjustability of the bracket considerably reduces its capacity to withstand heavy loading. The examples of previously patented waler brackets are disclosed in U.S. Pat. Nos. 2,340,439, 3,158,918, 3,185,433 and Re. 22,644.

BRIEF DESCRIPTION OF THE INVENTION

A first form of waler brace constructed in accordance with the present invention includes a base end for abutting against an associated concrete form wall and remote end. The remote end defines a bifurcated end portion and has a U-shaped structure including a pair of generally parallel legs and a transverse bight portion defining a waler retaining flange is pivotally supported to the bifurcated end of the brace by means of pivot fasteners secured through the free ends of the legs of the U-shaped member and corresponding furcations of the brace. With the U-shaped member opening away from the base end of the brace the waler retaining flange defining bight portion of the U-shaped member is closely spaced from the base end of the bracket and when the U-shaped member is swung 180° with the U-shaped member opening toward the base of the bracket, the waler retaining flange defining bight portion of the U-shaped member is spaced further from the base end of the brace.

A second form of the invention utilizes a waler brace, an inverted U-shaped channel member body closed at one end by means of an end wall for abutment against an associated concrete form wall and equipped with a slide shiftable along the U-shaped member and equipped with an outer waler retaining flange. The slide and the channel member include co-acting structure whereby the slide may be releasably secured in adjusted positions spaced along the channel member. Both the first and second forms of waler braces may utilize either a sliding wedge lock or a pivoted wedge lock.

The main object of this invention is to provide a waler brace which may be utilized for forming either a 3000-lb. form system utilizing only horizontal walers or a 5000-lb. forming system utilizing vertical studs as well as horizontal walers.

Another object of this invention is to provide a convertible waler bracket in accordance with the immediately preceding object and constructed in a manner enabling the basic structure of the waler to be utilized either in conjunction with a sliding wedge lock or a pivoted wedge lock.

Still another object of this invention is to provide a waler bracket which may be utilized in conjunction with various forms of ties.

A final object of this invention to be specifically enumerated herein is to provide a convertible waler bracket in accordance with the immediately preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
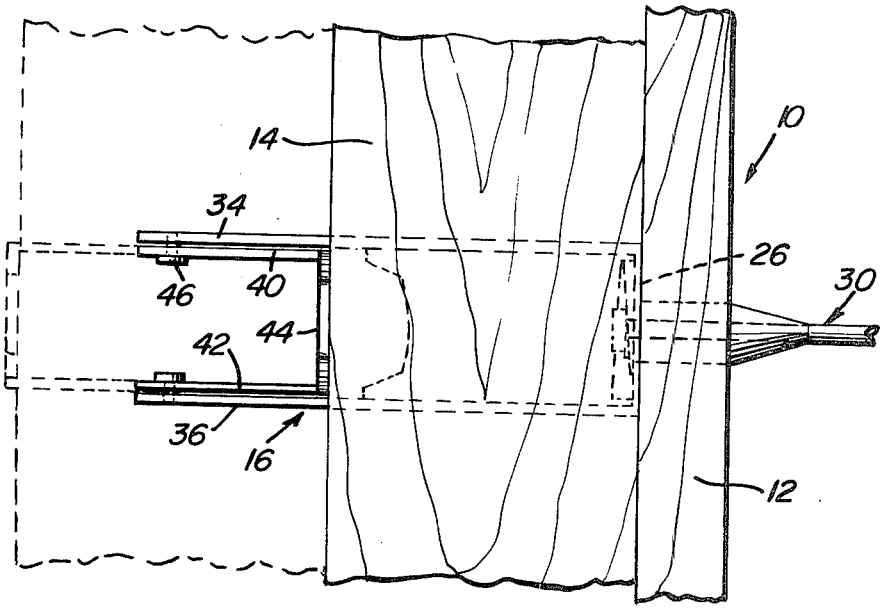
FIG. 1 is a fragmentary, top plan view of a concrete form utilizing a first form of convertible waler bracket.
Figure 2:
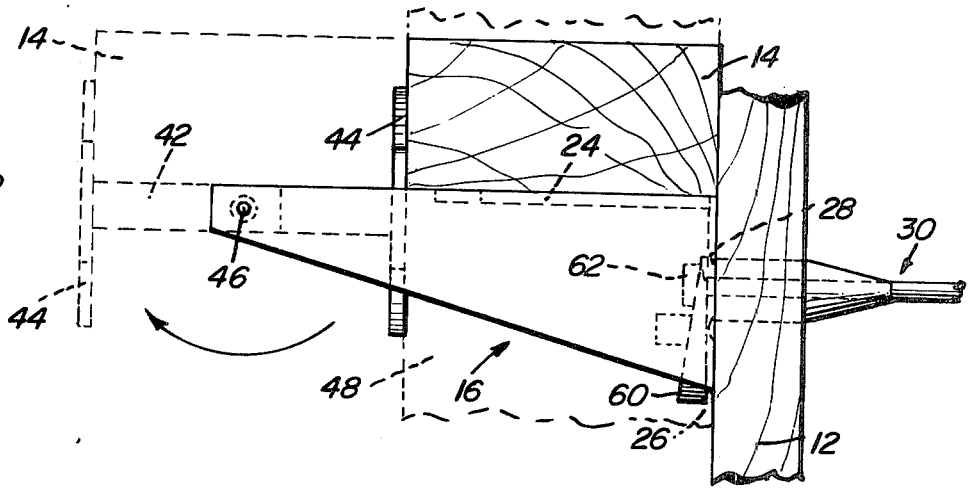
FIG. 2 is a fragmentary, elevational view of the assemblage illustrated in FIG. 1 with an alternate position of the shiftable portion of the waler bracket being illustrated in phantom lines.
Figure 3:
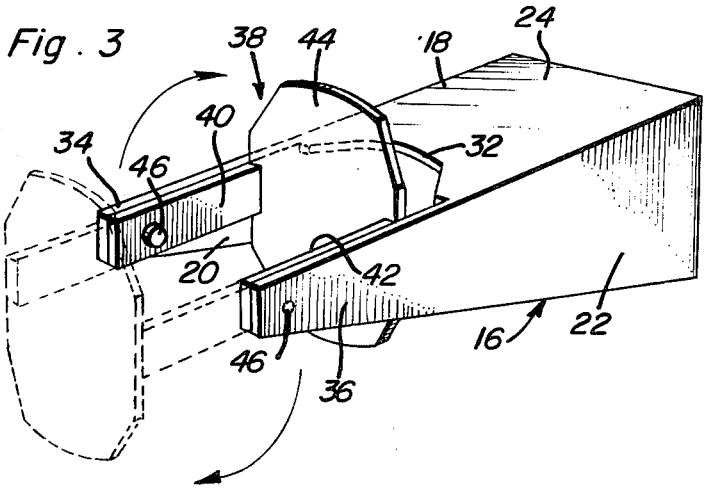
FIG. 3 is a perspective view of the first form of waler bracket with an alternate position of the shiftable portion thereof illustrated in phantom lines.

Referring now more specifically to the drawings and to FIGS. 1–3 in particular, the numeral 10 generally designates a concrete wall form including an upstanding form wall 12 and a horizontal waler 14 comprising a 2×4.

A first form of waler brace is referred to in general by the reference numeral 16 and comprises an elongated horizontal channel member 18 including opposite side flanges 20 and 22 interconnected along their upper marginal edge portions by means of a horizontal bight portion 24. Further, the opposite side flanges 20 and 22 taper toward one end portion of the channel member 18 and the other end portion of the channel member 18 is closed by means of a transverse end wall 26 suitably apertured as at 28 to receive a tie-rod assembly referred to in general by the reference numeral 30 therethrough.

The opposite side flanges 20 and 22 project outwardly beyond the outer end 32 of the bight portion 24 defining a pair of furcations 34 and 36. A U-shaped member referred to in general by the reference numeral 38 is provided and defines a pair of generally parallel legs 40 and 42 interconnected in one pair of ends by means of a transverse bight portion 44. The legs 40 and 42 are disposed immediately inwardly of the furcations 34 and 36 and the free ends of the legs 40 and 42 are pivoted to the free ends of the furcations 34 and 36, by means of fasteners 46.

From FIGS. 2 and 3 of the drawings, it may be seen that the U-shaped member 38 may be pivoted between 180° relatively displaced positions with the bight portion 44 spaced intermediate the opposite ends of the flanges 20 and 22 and the bight portion 44 spaced appreciably outwardly of the free ends of the furcations 34 and 36.

With the U-shaped member 38 adjusted as illustrated in solid lines in FIGS. 1 and 2 of the drawings, the waler brace 16 is adjusted to define a 3000-lb. system utilizing only the wall 12 and a 2×4 waler 14. On the other hand, if a 5000-lb. system is to be utilized, the U-shaped member 38 is pivoted to the phantom line position thereof illustrated in FIGS. 1, 2 and 3, and the form includes the wall 12, a waler 14 and a vertical stud 48. Of course, the U-shaped member 38 may be readily swung between the solid and phantom line positions illustrated in FIG. 3.

Further, conventional wedge or cam lock 60 is pivotally mounted on the end wall 26 of the waler bracket 16 and may be used to engage the enlarged head 62 of the tie-rod 30, the lock 60 including an arcuate slot therein concentric with the axis of rotation of the lock 60 and along opposite sides of which outwardly facing wedge surfaces extend for engagement with the head 62.

Figure 4:
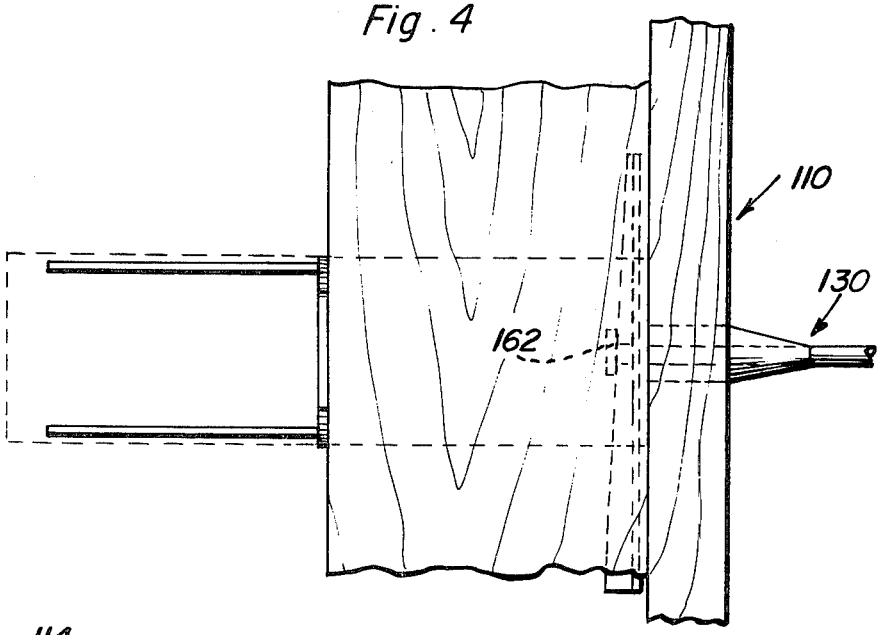
FIG. 4 is a fragmentary, top plan view similar to FIG. 1 but illustrating a second form of adjustable waler bracket.
Figure 5:
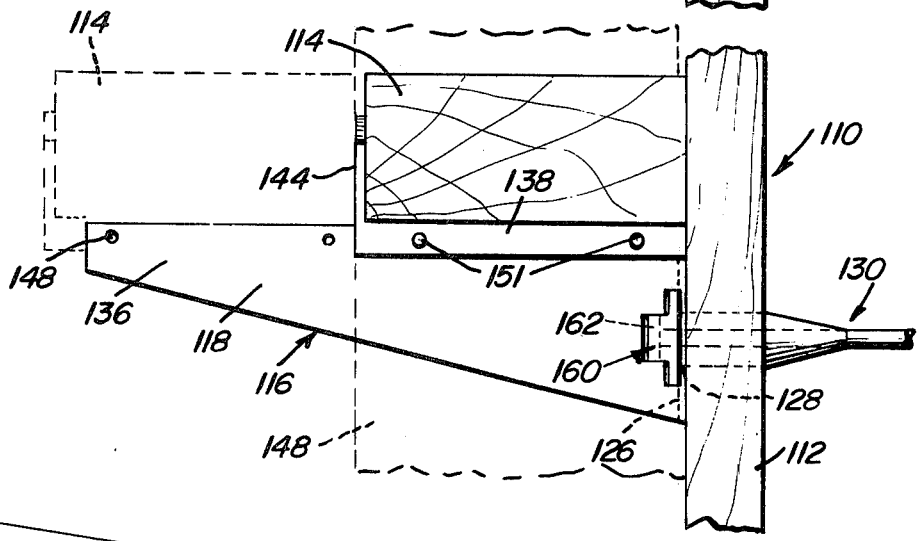
FIG. 5 is a fragmentary, elevational view of the assemblage illustrated in FIG. 4 with a second position of the shiftable portion of the bracket illustrated in phantom lines.
Figure 6:
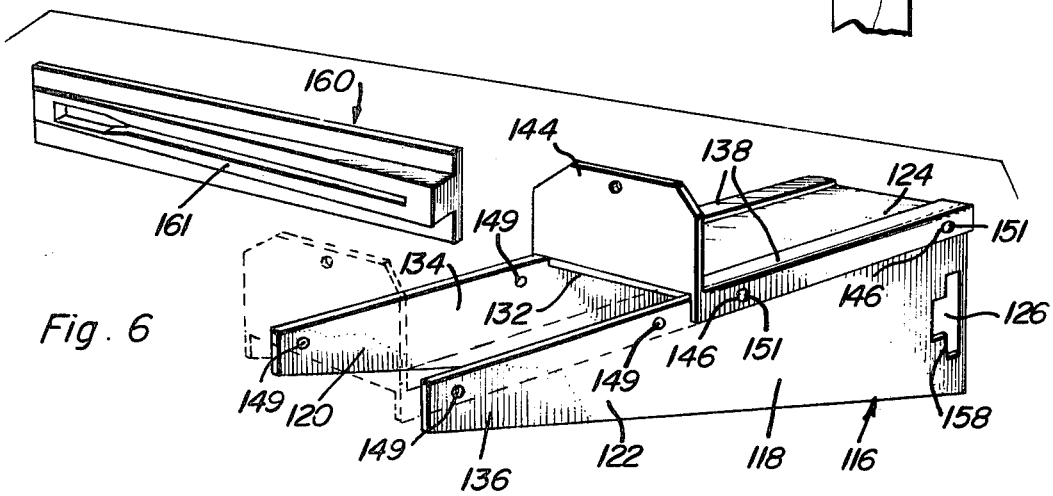
FIG. 6, is a perspective view of the second form of waler bracket together with a wedge-type lock illustrated in exploded position.

Referring now more specifically to FIGS. 4–6 of the drawings, there will be seen a second form referred to in general by the reference numeral 110 including a form wall 112 corresponding to the wall 12 and a tie-rod referred to in general by the reference numeral 130 corresponding to the tie-rod 30. A second form of waler brace is referred to in general by the reference numeral 116 and the brace 116 utilizes an inverted U-shaped channel member 118 which is similar in many respect to the channel member 18. The channel member 118 includes opposite side tapering flanges 120 and 122 interconnected along their upper marginal edge portions by means of a bight portion 124 and closed at one end by means of an end wall 126 centrally apertured as at 128. The bight portion 124 includes an outer end 132 and the free ends of the flanges 120 and 122 define furcations 134 and 136.

In lieu of the U-shaped member 38, the brace 116 includes a pair of angle members 138 joined at one pair of corresponding ends by means of an upstanding transverse flange 144 extending and secured therebetween the angle members 138 are slidingly engaged with the intersecting portions of the flanges 120 and 122 and the bight portion 124. The angle members 138 include longitudinally spaced apertures 146 and two pairs of longitudinally spaced apertures 149 are formed in each flange 118 and 120. The apertures 146 are registrable with corresponding pairs of apertures 149 and suitable fasteners 151 are removably secured through the registered apertures 146 and 149 for securing the angle members 138 in adjusted positions along the channel member 118.

If the angle members 138 are secured in the positions thereof illustrated in solid lines in FIGS. 5 and 6 of the drawings, the flange 144 defines a waler retaining flange for a waler 114 utilized in a 3000-lb. system. However, if the angle members 138 are secured in the phantom line positions illustrated in FIGS. 5 and 6 of the drawings, the retaining flange 144 is spaced further from the wall 112 and may be used in a 5000-lb. system provided with vertical studs 148 and walers 114.

A pivoted wedge lock similar to wedge lock 60 may be pivotally mounted on the end wall 126 of the waler bracket 116 and may be used to engage the enlarged head 162 of the tie-rod 130. However, a sliding wedge referred to in general by the reference numeral 160 is utilized in conjunction with waler bracket 116 and is received through openings 158 provided therefor in the flanges 120 and 122. The back side of the wedge 160 is disposed in sliding contact with the surface of the end wall 126 facing toward the free ends of the furcations 134 and 136 and the slotted wedge surface 161 of the wedge surface 160 is engaged behind the enlarged head 162 of the tie-rod 130. In addition, it will, of course, be noted that the waler brace 16 may have its flanges 20 and 22 provided with openings corresponding to the openings 158 in order that a sliding wedge may be used in conjunction with the waler bracket 116. Further, the pivoted wedge lock 60 may also be used on the end wall 126 of the waler bracket 116.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A convertible waler brace, said brace comprising an elongated horizontal brace member having one inner end adapted to abut the exterior surface of a form wall, said brace member including means defining a generally horizontal support portion extending along its upper portion, and upstanding waler retaining means supported from said brace member extending transversely of said brace member and projecting above said horizontal support portion, said waler retaining means and said horizontal brace member including co-acting means mounting said waler retaining means for shifting between predetermined first and second waler retaining positions spaced different distances from said one end of said brace member, said waler retaining means being pivotally supported from said brace member for angular displacement between said first and second waler retaining positions about a horizontal transverse axis.

2. The combination of claim 1 wherein said brace member comprises an elongated inverted channel member including depending opposite side flanges interconnected along at least some portions of their upper marginal edge portions by means of a bight portion extending therebetween comprising said horizontal support portion.

3. The combination of claim 1 wherein said one end of said brace member includes a transverse end wall apertured to receive one end portion of a tie-rod structure therethrough.

4. The combination of claim 3 wherein said end wall includes a pivoted cam lock mounted thereon for engaging and tensioning a tie-rod projecting through said apertured end wall.

5. The combination of claim 1 wherein said waler retaining means is displaced substantially 180° between said first and second waler retaining positions.

6. The combination of claim 5 wherein said brace member comprises an elongated inverted channel member including depending opposite side flanges interconnected along at least some portions of their upper marginal edge portions by means of a bight portion extending therebetween comprising said horizontal support portion, said waler retaining means comprising a pair of generally parallel legs joined at one pair of corresponding ends by means of a waler retaining flange extending therebetween, the other pair of ends of said legs being pivotally secured to the ends of said flanges remote from said one end of said brace member.

7. The combination of claim 6 wherein said legs are disposed on the inner sides of said flanges and said ends of said flanges remote from said one end of said brace member project endwise outwardly beyond the corresponding marginal portions of said bight portion a distance at least equal to the effective length of said legs, said waler retaining flange being receivable between the outwardly projecting ends of said flanges when said waler retaining flange swings toward said one end of said brace member.

8. A convertible waler brace, said brace comprising an elongated horizontal brace member having one inner end adapted to abut the exterior surface of a form wall, said brace member including means defining a generally horizontal support portion extending along its upper portion, and upstanding waler retaining means supported from said brace member extending transversely of said brace member and projecting above said horizontal support portion, said waler retaining means and said horizontal brace member including co-acting means mounting said waler retaining means for shifting between predetermined first and second waler retaining positions spaced different distances from said one end of said brace member, said brace member comprising an elongated inverted channel member including depending opposite side flanges interconnected along at least some portions of their upper marginal edge portions by means of a bight portion extending therebetween comprising said horizontal support portion, said waler retaining means comprising a pair of horizontal elongated and downwardly and inwardly opening angle members overlying and extending along opposite sides of said inverted channel member and interconnected at their ends remote from said one end of said horizontal brace member by means of an upstanding waler retaining flange extending therebetween, said waler retaining means being slidably mounted on the upper portion of said inverted channel member for adjustable positioning therealong, said waler retaining means and said brace member including co-acting means for releasably retaining said waler retaining means in adjusted position along said brace member.

* * * * *